United States Patent [19]

Kondo et al.

[11] 4,365,299

[45] Dec. 21, 1982

[54] METHOD AND APPARATUS FOR CONTROLLING AIR/FUEL RATIO IN INTERNAL COMBUSTION ENGINES

[75] Inventors: Toshio Kondo, Anjo; Akio Kobayashi; Tomomi Eino, both of Kariya; Masahiko Tajima, Takahama, all of Japan

[73] Assignee: Nippondenso Company, Limited, Kariya, Japan

[21] Appl. No.: 181,342

[22] Filed: Aug. 26, 1980

[30] Foreign Application Priority Data

Oct. 10, 1979 [JP] Japan ..... 54-131062

[51] Int. Cl.[3] ..... F02B 3/04; F02M 7/20

[52] U.S. Cl. ..... 364/431.06; 123/440; 123/480; 123/489

[58] Field of Search ..... 364/431; 123/440, 445, 123/475, 480, 486, 487, 489

[56] References Cited

U.S. PATENT DOCUMENTS

| | | | |
|---|---|---|---|
| 4,201,161 | 5/1980 | Sasayama et al. | 123/440 |
| 4,224,910 | 9/1980 | O'Brien | 123/440 |
| 4,282,842 | 8/1981 | Sasayama | 123/440 |
| 4,294,212 | 10/1981 | Aoki | 123/440 |
| 4,306,529 | 12/1981 | Chiesa et al. | 123/440 |
| 4,319,451 | 3/1982 | Tajima et al. | 123/440 |
| 4,321,903 | 3/1982 | Kondo et al. | 123/440 |
| 4,345,561 | 8/1982 | Kondo et al. | 123/440 |
| 4,348,727 | 9/1982 | Kobayashi | 364/431.06 |
| 4,348,728 | 9/1982 | Sagisaka et al. | 364/431.06 |

FOREIGN PATENT DOCUMENTS

| | | | |
|---|---|---|---|
| 55-96339 | 7/1980 | Japan | 123/486 |

*Primary Examiner*—Felix D. Gruber

*Attorney, Agent, or Firm*—Cushman, Darby & Cushman

[57] ABSTRACT

The amount of fuel supplied to an internal combustion engine is determined by controlling the opening interval of each fuel injection valve by correcting a standard interval obtained from the amount of intake air and engine speed by first to third correction factors. The first correction factor is dependent on coolant and intake air temperatures, while the second correction factor is dependent on a gas sensor output indicative of the air/fuel ratio of the mixture supplied to the engine. A plurality of third correction factors is provided for different amounts of intake air. Some of the third correction factors corresponding to intake air amounts at which the engine has been operated, are corrected in accordance with the value of the second correction factor. The state of correction is detected and when third correction factor has been corrected in the same direction by a relatively large amount, all of the third correction factors, which have been stored in a memory, are uniformly modified to renew the stored data.

11 Claims, 8 Drawing Figures

METHOD AND APPARATUS FOR CONTROLLING AIR/FUEL RATIO IN INTERNAL COMBUSTION ENGINES

FIELD OF THE INVENTION

The invention relates generally to a method and apparatus for controlling the air/fuel ratio of a mixture supplied to an internal combustion engine by means of a closed loop feedback control system. More particularly, the present invention relates to such a method and apparatus for controlling air/fuel ratio on the basis of the detected concentration of an exhaust gas component.

BACKGROUND OF THE INVENTION

In a typical conventional closed loop air/fuel ratio control system for an internal combustion engine, the air/fuel ratio of the mixture is etermined by correcting a basic or standard amount of fuel to be supplied to the engine cylinders in accordance with various information relating to engine parameters and the concentration of a given gas in the exhaust gases. In some conventional closed loop air/fuel ratio control systems, the above mentioned information or data are stored in a storage device for different operating conditions, and then the amount of fuel to be supplied to the engine cylinders is determined from the appropriate data read out from the storage device, such as RAM. Although these data stored in the storage device are refreshed each time the engine operates in a given operational condition, some of the data stored are not refreshed if the engine does not operate in the corresponding operational conditions.

For instance, when a motor vehicle is driven at a high altitude, more air is needed with respect to the amount of fuel in order to maintain a desired air/fuel ratio, such as the stoichiometric value because of the low air density. Therefore, data, which may be referred to as correction factors, are renewed to compensate for such deviation of the air fuel ratio. However, the engine may not be operated at all speeds or amounts of air intake. As a result, the data corresponding to engine conditions at which the engine has not been operated at a high altitude, have not yet been renewed, and thus continue to represent data for a low altitude. Therefore, when the engine speed or intake air amount changes to a new value which has not been experienced at a high altitude, feedback control of the air/fuel ratio cannot be performed in a suitable manner during transient periods due to time lag associated with integral processing of the gas sensor output to update the data. That is, the feedback control in the above-mentioned conventional system cannot catch up with the actual variation in air/fuel ratio.

SUMMARY OF THE INVENTION

The present invention has been developed in order to remove the above mentioned disadvantage in a closed loop air/fuel ratio control system for an internal combustion engine.

It is, therefore, a primary object of the present invention to provide a method and apparatus for accurately and quickly controlling the air/fuel ratio of an air/fuel mixture supplied to an internal combustion engine irrespectively of variation in engine operational conditions.

Another object of the present invention is to provide a method and apparatus for controlling the air/fuel ratio by correcting a standard or reference air/fuel ratio in view of correcting factors, one of which is shifted uniformly throughout a possible entire range of the operational conditions, such as amounts of intake air, of the engine.

BRIEF DESCRIPTION OF THE DRAWINGS

These and other objects and features will be more readily apparent from the detailed description of the preferred embodiment taken in conjunction with the accompanying drawings in which.

DETAILED DESCRIPTION OF THE PREFERRED EMBODIMENT

Figure 1:
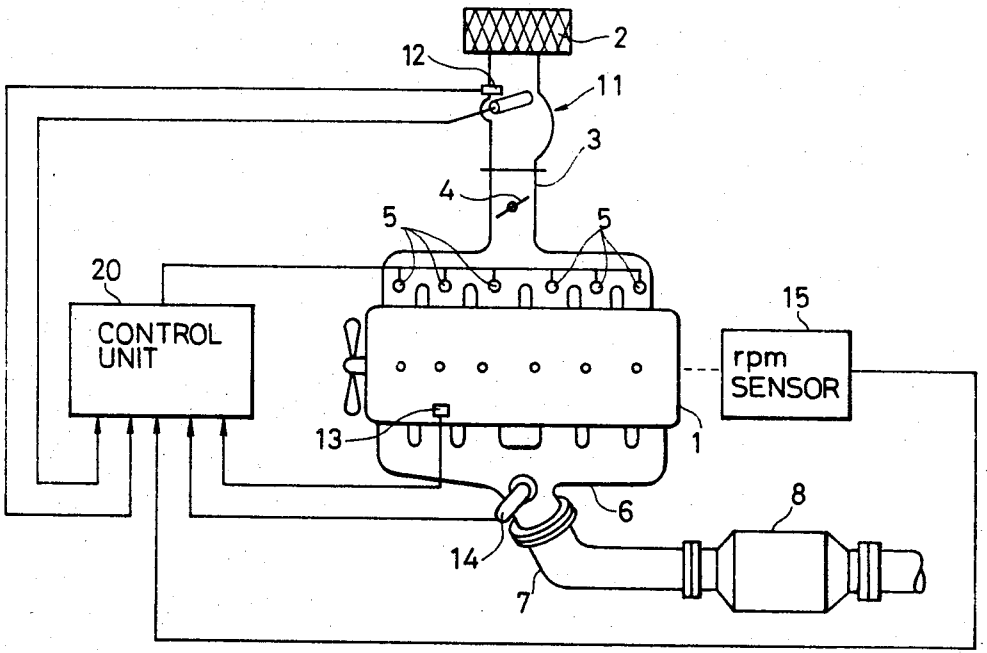
FIG. 1 is a schematic view of an embodiment of the apparatus for controlling air/fuel ratio according to the present invention.

Reference is now made to FIG. 1 which is a schematic view of an embodiment of the present invention. An internal combustion engine 1, which is mounted on a motor vehicle (not shown), is of well known 4-cycle spark-ignition type. The engine 1 is supplied with air via an air cleaner 2, an intake manifold 3 and a throttle valve 4 provided in the intake manifold 3. The engine 1 is also supplied with fuel via a plurality of fuel injection valves 5 corresponding to each cylinder from a fuel supply system (not shown). The exhaust gases produced as the result of combustion are discharged into the atmosphere through an exhaust manifold 6, an exhaust pipe 7 and a three-way catalytic converter 8.

The intake manifold 3 is equipped with an airflow meter 11 constructed of a movable flap and a potentiometer, the movable contact of which is operatively connected to the flap. The intake manifold 3 is further equipped with a thermistor type temperature sensor 12 for producing an output analog signal indicative of the temperature of the intake air. A second thermistor type temperature sensor 13 is shown to be coupled to the engine 1 for producing an output analog signal indicative of the coolant temperature.

An oxygen sensor 14 is disposed in the exhaust manifold 6 for producing an output analog signal indicative of the concentration of oxygen contained in the exhaust gases. As is well known, the oxygen concentration represents the air/fuel ratio of the mixture supplied to the engine 1, and for instance, the output voltage of the oxygen sensor 14 is approximately 1 volt when the detected air/fuel ratio is smaller, i.e. richer, than the stoichiometric air/fuel ratio; and is approximately 0.1 volt when the detected air/fuel ratio is higher, i.e. leaner, than the same. Accordingly, the gas sensor output can be treated as a digital signal.

A rotational speed sensor 15 is employed for detecting the engine rpm. Namely, the rotational speed of the engine crankshaft (not shown) is indicated by the number of pulses produced per unit time. Such a pulse train signal, i.e. a rotation synchronized signal, may be readily derived from the primary winding of the ignition coil of the ignition system (not shown).

The output signals of the above-mentioned circuits, namely, the airflow meter 11, the intake air temperature sensor 12, the coolant temperature sensor 13, the oxygen sensor 14, and the rotational speed (rpm) sensor 15 are respectively applied to a control unit 20 which may be constructed of a microcomputer.

Figure 2:
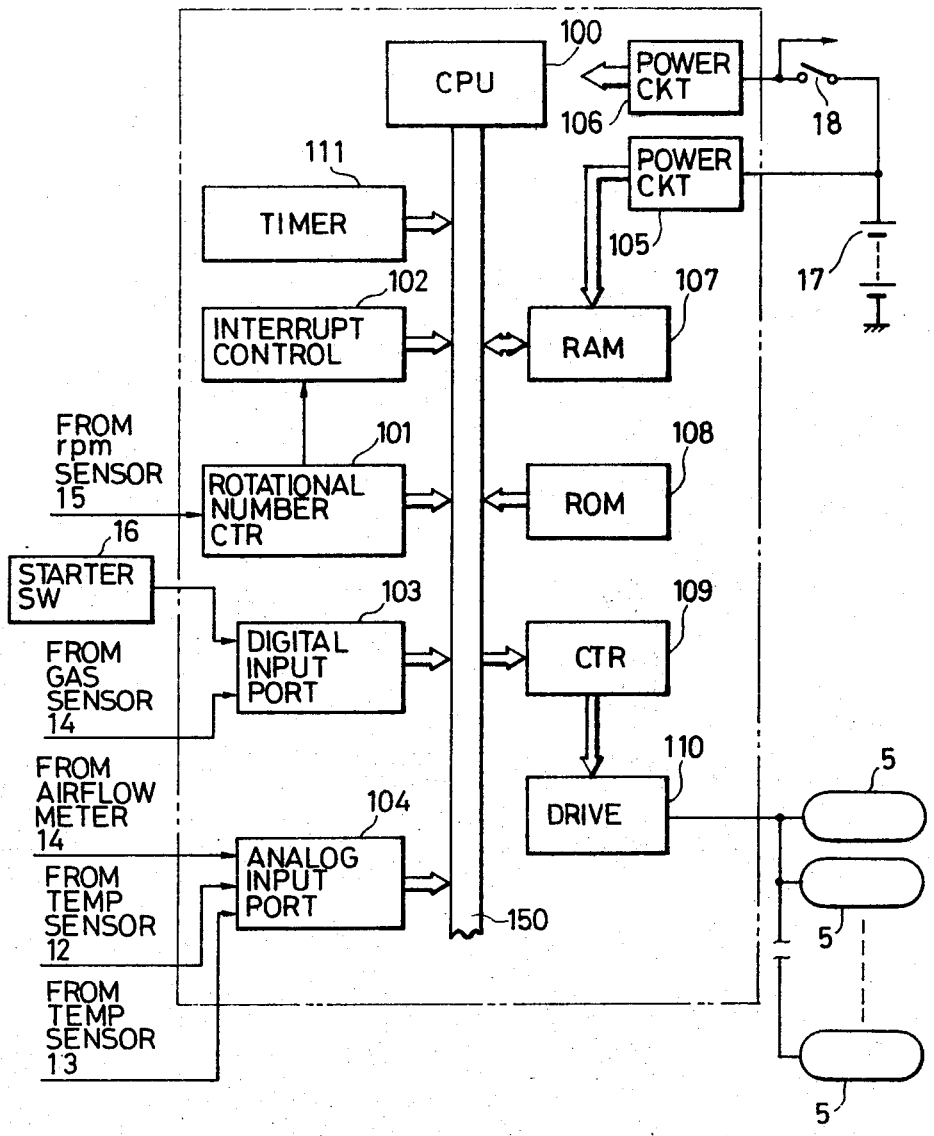
FIG. 2 is a schematic block diagram of the control unit shown in FIG. 1.

FIG. 2 illustrates a detailed block diagram of the control unit 20 shown in FIG. 1. The control unit 20 comprises a microprocessor, i.e. a central processing unit CPU, for calculating the amount of fuel to be supplied to the engine 1 in accordance with various information applied thereto. A counter 101 for counting the number of rotations of the engine crankshaft is responsive to the output signal of the above-mentioned rotational speed sensor 15. The counter 101 has first and second outputs respectively connected to a common bus 150 and to an input of an interrupt control unit 102 the output of which is connected to the common bus 150. With this arrangement the counter 101 is capable of supplying the interrupt control unit 102 with an interrupt instruction. In receipt of such an instruction the interrupt control unit 102 produces an interrupt signal which is fed to the CPU 100 via the common bus 150.

A digital input port 103 is provided for receiving digital signals from the air/fuel ratio sensor 14 and from a starter switch 16 with which the engine starter (not shown) is turned on and off. These digital signals are applied via the common bus 150 to the CPU 100. An analog input port 104, which is constructed of an analog multiplexer and an A/D converter, is used to convert analog signals from the airflow meter 11, the intake air temperature sensor 12, and from the coolant temperature sensor 13 in a sequence, and then to deliver the converted signals via the common bus 150 to the CPU 100.

A first power supply circuit 105 receives electric power from a power source 17, such as a battery mounted on the motor vehicle. This first power supply circuit 105 supplies a RAM 107, which will be described hereinafter, with electrical power, and is directly connected to the power source 17 without a switch. A second power supply circuit 106 is, however, connected to the power source 17 via a switch 18, which may be an ignition key or a switch controlled by the ignition key. The second power supply circuit 106 supplies all of the circuits included in the control unit 20 except for the above-mentioned RAM 107.

The RAM 107 is used to temporarily store various data during the operations of the CPU 100. Since the RAM 107 is continuously fed with electrical power from the power source 17 through the first power supply circuit 105, the data stored in the RAM are not erased or cancelled although the ignition key 18 is turned off to stop the engine operation. Namely, this RAM 107 can be regarded as a non-volatile memory. Data indicative of third correction factors K3, which will be described later, will be stored in the RAM 107. The RAM 107 is coupled via the common bus 150 to the CPU 100 so that various data will be written in and read out from the RAM 107 as will be described hereinafter.

A read-only memory (ROM) 108 is connected via the common bus 150 to the CPU 100 for supplying the same with an operational program and various constants. As is well known, the data or information contained in the ROM 108 have been prestored therein during manufacturing in non-erasable form so that the data can be maintained as they are irrespectively of the manipulation of the ignition key 18.

A counter 109 including a down counter and registers is provided for producing pulse signals, the pulse width of which corresponds to the amount of fuel to be supplied to the engine 1. The counter 109 is coupled via the common bus 150 to the CPU 100 for receiving digital signals indicative of the amount of fuel which should be fed to the engine 1. Namely, the counter 109 converts its digital input into a pulse train signal, the pulse width of which is varied by the digital input, so that fuel injection valves 5 are successively energized for an interval defined by the pulse width to inject fuel into the intake manifold 3. The pulse train signal produced in the counter 109 is then applied to a driving stage 110 for producing a driving current with which the fuel injection valves 5 are energized successively.

A timer circuit 111 is connected via the common bus 150 to the CPU 100 for supplying CPU 100 with information from which the lapse of time can be measured.

After the rotation number counter 101 detects the engine speed, the aformentioned interrupt instruction is produced. In response to the interrupt instruction the interrupt control unit 102 produces an interrupt signal which will be fed to the CPU 100. Accordingly, the running program stops to execute the interrupt routine.

Figure 3:
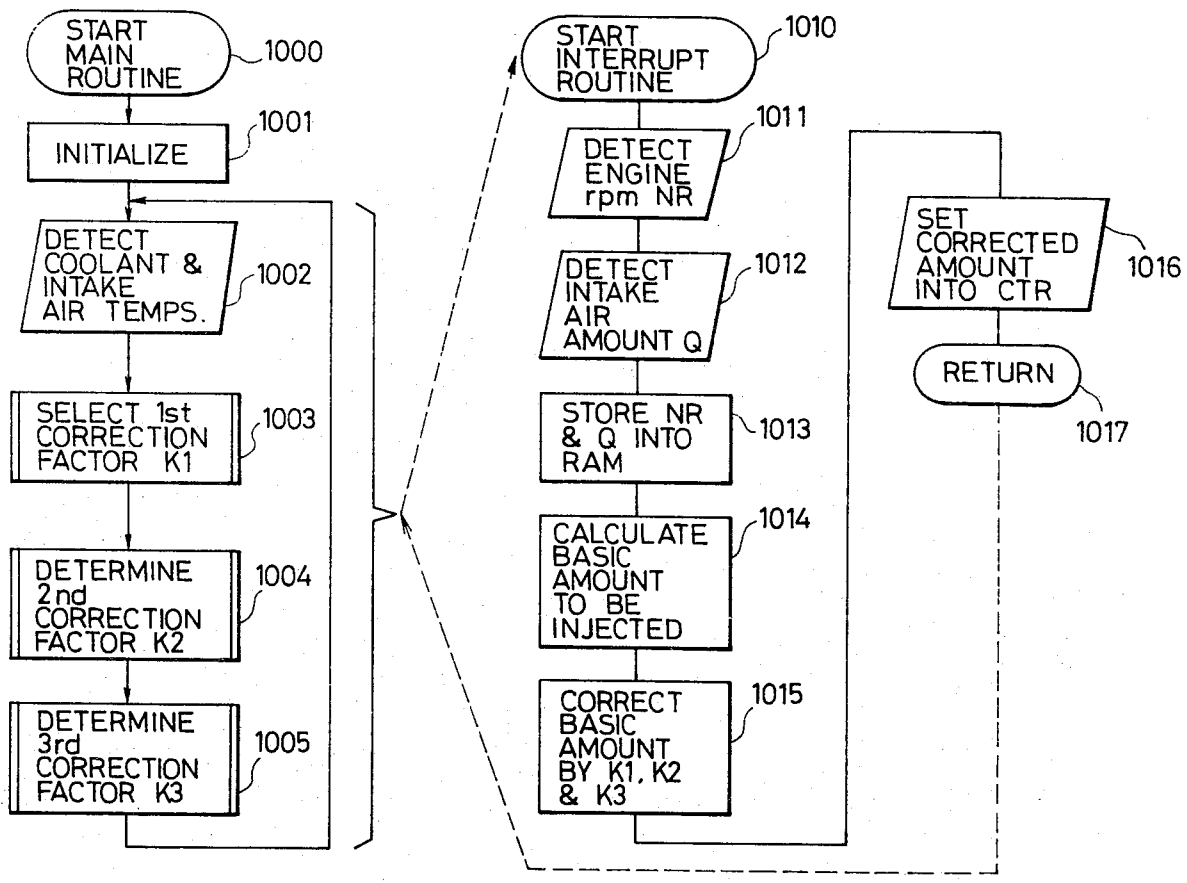
FIG. 3 is a flowchart showing the operational steps of the central processing unit shown in FIG. 1.

FIG. 3 is a flowchart showing the operational steps of the CPU 100, and the function of the CPU as well as the operation of the system of FIG. 2 will be described with reference to this flowchart. The engine 1 starts running when the ignition key 18 is turned on. The control unit 20 is thus energized to start the operational sequence from its starting step 1000. Namely the main routine of the program will be executed. In a following step 1001, initialization is performed, then in a following step 1002, digital data of the coolant temperature and the intake air temperature applied from the analog input port 104 are stored. Then in a following step 1003, a first correction factor K1 is obtained on the basis of the above-mentioned data, and this first correction factor K1 will be stored in the RAM 107.

The above-mentioned first correction factor K1 may be obtained, for instance, by selecting one value, in accordance with the coolant and intake air temperatures, from a plurality of values prestored in the ROM 108 in the form of a map. If desired, however, the first correction factor K1 may be obtained by solving a given formula with the above-mentioned data. In a following step 1004, the output signal of the air/fuel ratio sensor 14 applied through the digital input port 103 is read, and a second correction factor K2, which will be described hereinafter, is either increased or decreased as a function of time measured by the timer 111. The second correction factor K2 indicates a result related to a continuing sum of the air/fuel ratio sensor output signal and thus indicates, in a sense commonly employed by those skilled in the art, a result of integration and this second correction factor K2 is stored in the RAM 107.

Figure 4:
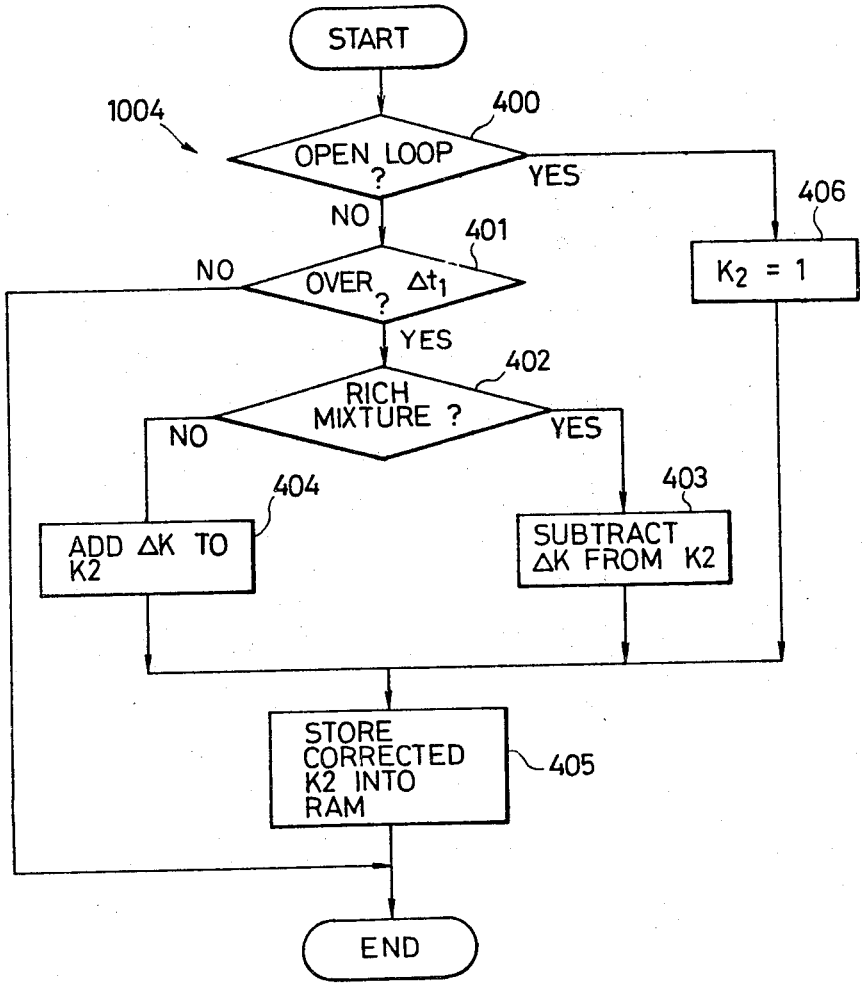
FIG. 4 is a detailed flowchart of the steps included in the step for processing a second correction factor, which step is shown in FIG. 3.

FIG. 4 is a flowchart showing detailed steps included in the step 1004 of FIG. 3, which steps are used to either increase or decrease in a stepwise fashion, i.e., to "integrate" in the sense referred to above, the second correction factor K2. In a step 400, it is detected whether the feedback system is in an open loop condition or in a closed loop position. In order to detect such a state of the feedback system it is detected whether the air-fuel ratio sensor 14 is active or not. This step 400, however, may be replaced by a step of detecting whether the coolant temperature or the like is above a given level to be able to perform feedback control. When a feedback control cannot be performed, i.e. when the feedback system is in an open loop condition, a following step 406 takes place to let K2 equal to 1, and then step 405 is performed.

When a feedback control can be performed, a step 401 takes place to detect whether a unit time $\Delta t_1$ has elapsed. If the answer of the step 401 is NO, the operation of the step 1004 terminates. If the answer of this step 401 is YES, i.e., when the unit time $\Delta t_1$ has elapsed, a following step 402 takes place to see whether the output signal of the air/fuel ratio sensor 14 indicates that the air/fuel mixture is rich or not. Assuming that a high level output signal of the air/fuel ratio sensor 14 indicates a rich mixture, when such a high level output signal is detected, the program enters into a step 403 in which the value of K2, which has been obtained in the prior cycle, is reduced by $\Delta$K2. On the contrary, when the air/fuel mixture is detected to be lean, namely, when the output signal of the air-fuel sensor 14 is low, a step 404 takes place to raise the value of K2 by $\Delta$K2. After the value of K2 is either increased or decreased as mentioned in the above, the aforementioned step 405 takes place to store K2 into the RAM 107.

Figure 5:
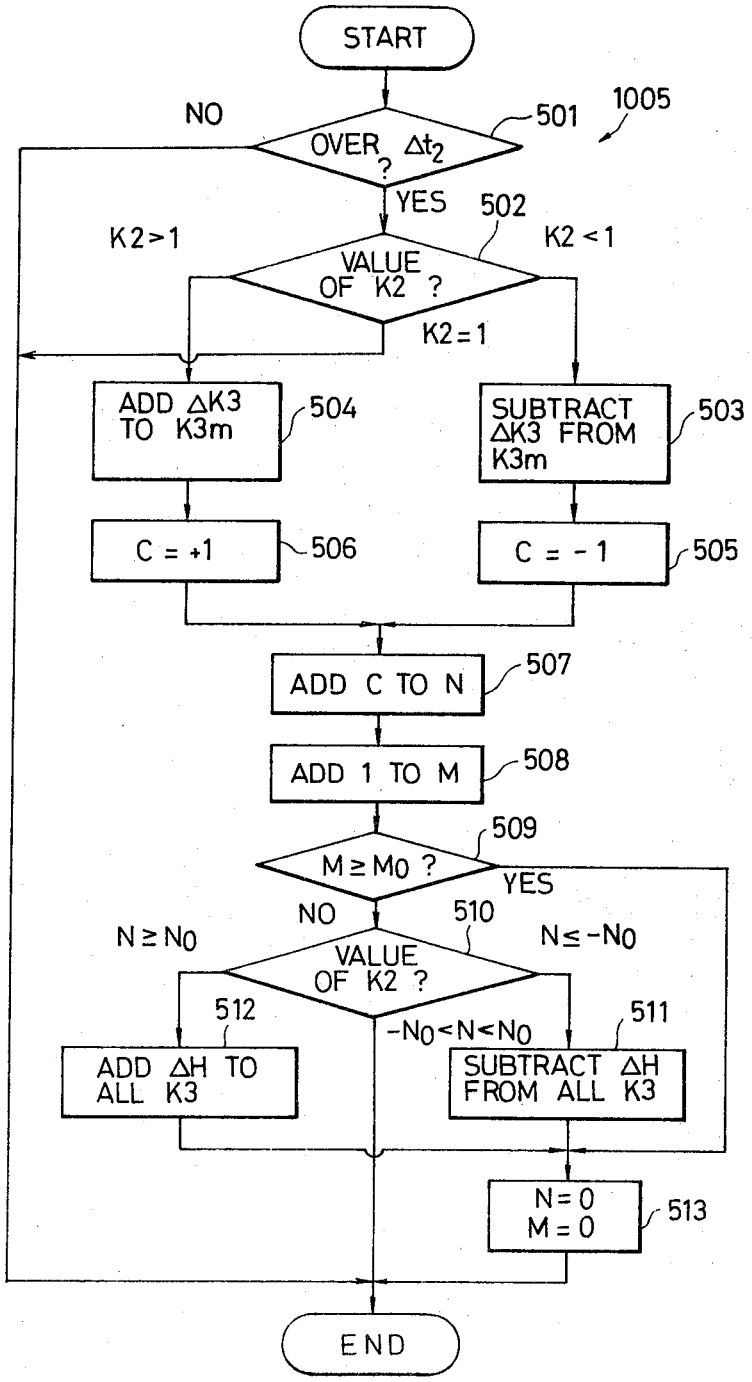
FIG. 5 is a detailed flowchart of the steps included in the step for processing a third correction factor, which step is also shown in FIG. 3.

Turning back to FIG. 3, a step 1005 follows the step 1004 which has been described in detail with reference to FIG. 4. In the step 1005, a third correction factor K3 is calculated by varying the same, and the result of the calculation will be stored in the RAM 107. A detailed flowchart of the step 1005 is shown in FIG. 5, and the operation of K3 will be described with reference to FIG. 5.

In a step 501, it is detected whether a second unit time $\Delta t_2$ has elapsed or not. If the measured period has not exceeded the unit time $\Delta t_2$, the step of 1005 ends. On the other hand, if the period has exceeded the unit time $\Delta t_2$, a following step 502 takes place. In this step 502, the value of K2 is detected, and if K2=1, no further step will take place ending the step 502.

A number of third correction factors K3 constitute a map in the RAM 107 in such a manner that each of the third connection factors K3 corresponds to a different amount Q of the intake air of the engine 1. One of the third correction factors K3 on the map corresponding to an amount Q of the intake air of an $m^{th}$ order in a series of values of amounts Q is designated as K3m. In accordance with the preferred embodiment of the present invention, the amount Q of the intake air can take on any one of thirty-two values as the amount varies from a minimum amount at idling to a maximum mount at full load. As a result, thirty-two values of K3 respectively corresponding to the thirty-two values of the intake air amounts are stored in the form of a map in the RAM 107. If K2<1, a step 503 takes place, while if K2<1, a step 504 takes place. In the step 503, the value of K3m, which has been obtained in the prior cycle, is reduced by $\Delta$K3, and on the other hand, in the step 504, the same value of K3m is raised by $\Delta$K3. The result of the subtraction or addition is then stored in a corresponding address in the map in the RAM 107. In a step 505 following the step 503, a constant C is set to $-1$, while in a step 506 following the step 504, the same constant C is set to $+1$. After the constant C has been set to either $-1$ or $+1$ in the step 505 or 506, the constant C is added to a value N indicative of the direction and magnitude, i.e. the degree of correction, of K3 in a step 507. Then in a following step 508, 1 is added to a value M indicative of the number of corrections made. These values M and N have been respectively set to zero in the above-mentioned initialization step 1001 when the ignition key 18 was turned on.

In a following step 509, the value of M is compared with a predetermined value $M_0$, and if $M \geqq M_0$, namely, when the number of corrections of K3 exceeds or equals the predetermined number $M_0$, the operational flow enters into a step 513 in which both of the values N and M are respectively set to zero. If $M < M_0$, namely, when the number of corrections of K3 is below the predetermined number, a step 510 takes place. In the step 510, the value of N is detected by comparing the same with two predetermined values $N_0$ and $-N_0$. If $N \leqq -N_0$, namely, K3 is now being corrected in the direction of reducing the value thereof while the absolute magnitude of N is greater than $N_0$, a step 511 takes place. If, on the other hand, $N \geqq N_0$, namely, when K3 is now being corrected in the direction of raising the value thereof while the magnitude of N is greater than $N_0$, step 512 takes place. The processing step 1005 ends when N is between $N_0$ and $-N_0$, namely, when $-N_0 < N < N_0$.

In the step 511, all of the values of K3 prestored in the RAM 107 are corrected by uniformly subtracting a given amount $\Delta$H from each of the values of K3. On the other hand, in the step 512, all of the values of K3 prestored in the RAM 107 are corrected by uniformly adding the given amount $\Delta$H to each of the values of K3.

After one of the steps 511 and 512 is executed, a step 513 takes place in which the values of N and M are respectively initialized to be set to zero. As such initialization is completed, the operations in the step 1005 terminate.

Figure 6A:
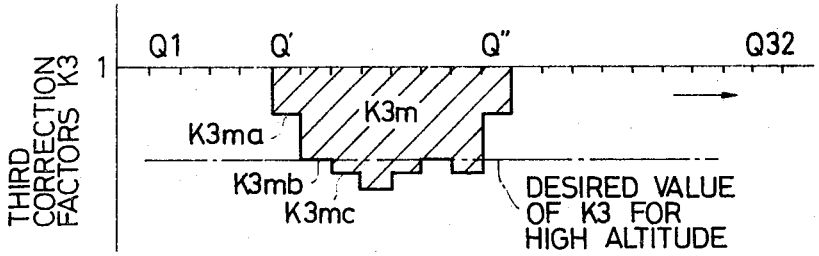
FIGS. 6A, 6B and 6C are graphical representations useful for understanding the operational steps of FIG. 5.
Figure 6B:
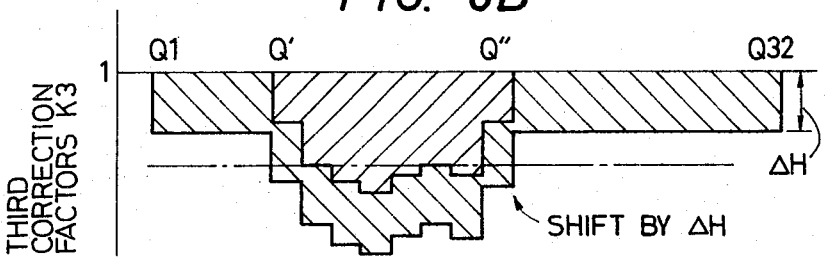
Figure 6C:
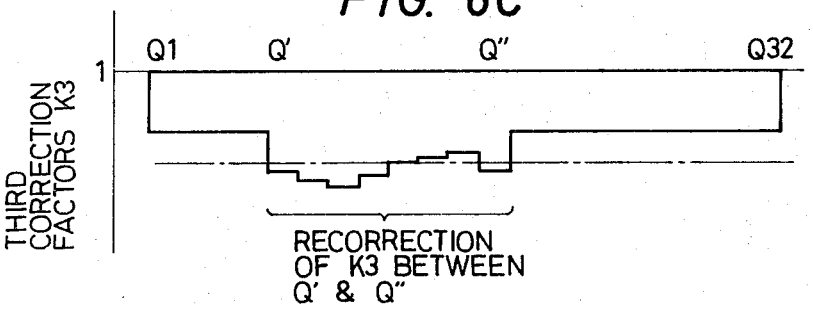

The above described operations in the step 1005 of FIG. 5 will be further described in detail with reference to FIGS. 6A, 6B and 6C. FIGS. 6A to 6C are graphical representations of the third correction factors K3 with respect to various amounts Q of the intake air.

Let us assume that a motor vehicle equipped with a closed loop air/fuel ratio control system according to the present invention has been driven on an ascent and is now running at a relatively high altitude. Let us further assume that the amount of the intake air of the vehicle engine 1 varies within a specific range or region defined by Q' and Q'' at this time as shown in FIG. 6A. Namely, the engine 1 is not operated with an amount of the intake air which is below Q' or above Q''. As is well known, the density of air decreases as the altitude increases so that a desired air/fuel ratio for an internal combustion engine of a motor vehicle driven at high altitude places is different from a predetermined air/fuel ratio, which is usually set to be suitable for a relatively low altitude.

In order to compensate for the above-mentioned deviation in air/fuel ratio due to the difference in altitude, the third correction factors K3ma, K3mb, K3mc . . . in the operating region, are corrected, i.e. reduced in this case, as shown in FIG. 6A. In FIG. 6A, a hatched portion indicates each magnitude of the third correction factors K3ma, K3mb, K3mc . . . respectively corresponding to each amount of the intake air between Q' and Q''. A dot-dash line in each of FIGS. 6A, to 6C indicates a desired value of the third correction factor K3 for compensating for the deviation of the air/fuel ratio due to the altitude variation. Each of the third correction factors K3ma, K3mb, K3mc . . . is corrected, as mentioned hereinabove through the steps 502 and 503, or through the steps 502 and 504 of FIG. 5, as the engine operates at a corresponding amount of the intake air between Q' and Q'' so that the magnitude of each of the third correction factors K3ma, K3mb, K3mc . . . approaches the above-mentioned desired value indicated by the dot-dash line.

It will be understood from the above, that the third correction factors K3ma, K3mb, K3mc . . . between Q' and Q'' are corrected as long as the engine operates at an amount of the intake air between Q' and Q'', while remaining third correction factors respectively corresponding to amounts of the intake air between Q1 and Q', and between Q'' and Q32 are not corrected at all. Namely, the values of these remaining third correction factors remain 1. This means that when the engine 1 operates at an amount of the intake air which is below Q' or above Q'', there might be a possibility that the feedback system cannot catch up with the variation of the air/fuel ratio since a third correction factor K3m corresponding to an actual amount of the intake air has not been corrected.

In accordance with the present invention, however, the values of the third correction factors K3 for the entire range of the amounts of the intake air between Q1 and Q32 are simultaneously and uniformly modified by ΔH as shown in FIG. 6B. This modification of all of the third correction factors K3 is done through the steps from 507 to 511 or from 507 to 512 of FIG. 5. As the result of the modification, the values of the third correction factors K3 stored in the RAM 107 are shifted in one direction by a given degree defined by the constant ΔH. In other words, the state of variation of the third correction factors K3ma, K3mb, K3mc . . . , is detected by finding the number M of corrections made, and the degree N of corrections toward either direction through the steps 509 and 510. After all of the third correction factors K3 are modified uniformly by ΔH, the values N and M are respectively initialized as described hereinabove, and then the operational flow returns to the step 1002 of FIG. 3. Accordingly the third correction factors K3ma, K3mb, K3mc . . . between Q' and Q'' are again corrected by either +ΔK3 or −ΔK3 in accordance with a new second correction factor k2 which has been obtained by this time. As the engine 1 operates at amounts of the intake air between Q' and Q'', the values of the third correction factors K3ma, K3mb, K3mc . . . are corrected respectively by the circulation of the main routine shown in FIG. 5 so that these values of the third correction factors K3ma, K3mb, K3mc . . . approach the above-mentioned desired value indicated by the dot-dash line as shown in FIG. 6C. During the above-mentioned circulation the absolute value of N indicative of the direction and magnitude of correction of the third correction factors K3ma, K3mb, K3mc . . . is smaller than the predetermined value $N_0$, namely, $-N_0 > N > N_0$, so that none of the steps 511 to 512 takes place. As a result, the third correction factors K3 for amounts of the intake air between Q1 and Q' and between Q'' and Q32 would not change maintaining the same magnitude as that of FIG. 6B.

From the above it will be understood that the third correction factors K3 throughout the entire range of the intake air amounts are modified uniformly at the same time by monitoring the state of the correction of the third correction factors K3ma, K3mb, K3mc . . . within a given range of the intake air amounts. Therefore, when the amount of the intake air of the engine 1 suddenly drops below Q' or rises above Q'', the air/fuel ratio of the mixture supplied to the engine 1 can be controlled in a desired manner owing to the modified third correction factors K3 as shown in FIG. 6C.

Turning back to FIG. 3, it will be described how the air/fuel ratio of the mixture supplied to the engine 1 is controlled in accordance with the present invention. The operational steps 1002 to 1005 of the main routine are repeatedly executed normally. However, when the aforementioned interupt signal is applied to the CPU 100 from the interrupt control circuit 102, an interrupt routine also illustrated in FIG. 3 takes place. Namely, the execution of the steps of the main routine is stopped to enter into the interrupt routine even though execution of one cycle of the main routine has not yet been completed.

After the operational flow enters into the START step 1010 of the interrupt routine, a first step 1011 follows in which a datum indicative of the rotational speed NR of the engine crankshaft from the rotational number counter 101 is read. In a following steps 1012, a datum indicative of the amount Q of the intake air from the analog input port 104 is read. These data NR and Q are respectively stored in the RAM 107 in a following step 1013. Then these data NR and Q are read out from the RAM 107 to calculate a basic amount of fuel to be injected into each cylinder of the engine 1 through the intake manifold 3. The amount of fuel injected into each cylinder is proportional to a period for which each of the electromagnetic injection valves 5 is made open. The basic amount of fuel, which corresponds to a basic opening interval, is expressed in terms of t, and this value of t is given by the following formula:

$$t = F \times (Q/NR)$$

wherein F is a constant.

After the basic amount of opening interval t has been obtained in a step 1014, this basic amount or opening interval t will be corrected by the above-mentioned correction factors K1, K2 and K3 in a following step 1015. Namely, these correction factors, which have been obtained through the operations in the main routine, are read out from the RAM 107, and then a correct opening or injecting interval T will be calculated by the formula given below:

$$T = t \times K1 \times K2 \times K3$$

The opening interval T, which has been obtained as the result of the above-mentioned calculation, is then set in the counter 109 so as to effect the aforementioned pulse width modulation. Each of the injection valves 5 will be energized for the opening interval T in receipt of each pulse from the driving circuit 110 to inject a given amount of fuel defined by the interval T. The interrupt routine terminates at an END step 1017 after the completion of the step 1016 and thus the operational flow returns to the original step in the main routine where the operation has been interrupted.

In the above described embodiment, although the values of K3 are modified by ΔH by either subtracting or adding ΔH from or to K3, this modification by ΔH may be achieved by using another correction factor K4. Namely, the values of K3 may be maintained as they are, and the newly introduced correction factor K4 may be modified by ΔH uniformly throughout the entire range of the intake air amounts so that the injection or opening interval T may be obtained by the following formula:

$$T = t \times K1 \times K2 \times K3 \times K4$$

The present invention has been described in the above with reference to an embodiment in which the amount of fuel supplied to an internal combustion engine via a plurality of fuel injection valves is controlled. However, it will be noticed that the present invention may be adapted to an air/fuel ratio control system which controls the air/fuel ratio of the mixtures supplied via an electronic carburetor. It will be understood by those skilled in the art that many modifications and variations may be made without departing from the spirit of the present invention.

What is claimed is:

1. A method of controlling the air/fuel ratio of an air/fuel mixture supplied to an internal combustion engine by a feedback control system, comprising the steps of:

(a) determining a first correction factor from a plurality of predetermined values in accordance with detected engine parameters;

(b) determining a second correction factor in accordance with an air/fuel ratio represented by an output signal of a gas sensor which detects the concentration of a given gas in the exhaust gases of said engine;

(c) determining third correction factors, each of said third correction factors for a different engine operational condition, said third correction factors corresponding to a region of said engine operational conditions in which said engine has been operated being changed in accordance with the value of said second correction factor, remaining said third correction factors being unchanged;

(d) detecting the state of variation of said third correction factors;

(e) modifying all of said third correction factors uniformly throughout the possible entire range of said operational conditions of said engine in accordance with the detected state of variation of said third correction factors; and (f) determining the air/fuel ratio of the mixture to be supplied to said engine by correcting a standard value, which is obtained on the basis of the amount of the intake air and the rotational speed of said engine, by said first, second and third correction factors.

2. A method as claimed in claim 1, wherein said step of determining said first correction factor is performed by selecting a value from a number of predetermined values prestored in a storage device in the form of a map.

3. A method as claimed in claim 1, wherein said engine parameters used in said step of selecting said first correction factor are engine coolant temperature and intake air temperature.

4. A method as claimed in claim 1, wherein said step of determining said second correction factor comprises the steps of:

(a) detecting whether said feedback control system is in an open loop condition or not;

(b) setting said second correction factor to a predetermined number if said feedback control system is in an open loop condition;

(c) detecting whether a predetermined period of time has elapsed if said feedback control system is in a closed loop condition;

(d) detecting whether the output signal of said gas sensor indicates a rich mixture or a lean mixture if said predetermined period of time has elapsed;

(e) changing the value of said second correction factor obtained in the prior cycle by a first given value in a first direction if said gas sensor output indicates a rich mixture;

(f) changing the value of said second correction factor obtained in the prior cycle by a second given value in a second direction if said gas sensor output indicates a lean mixture; and (g) storing the value of said second correction factor into a storage device.

5. A method as claimed in claim 1, wherein said step of determining said third correction factors comprises the steps of:

(a) detecting whether a predetermined period of time has elapsed;

(b) detecting the value of said second correction factor if said predetermined period of time has elapsed;

(c) changing the value of said third correction factor obtained in the prior cycle by a first given value in a first direction if said second correction factor is below a first number;

(d) changing the value of said third correction factor obtained in the prior cycle by a second given value in a second direction if said second correction factor is above said first number;

(e) setting a constant to a second number if said first direction change has been made;

(f) setting the constant to a third number if said second direction change has been made;

(g) adding said constant to a first variable value indicative of the magnitude of said third correction factor and the direction of the correction made with respect to said third correction factor;

(h) incrementing a second variable value indicative of the number of the corrections made with respect to said third correction factors;

(i) detecting whether said second variable value is equal to or above a first predetermined value or not;

(j) detecting said first variable value if said second variable value is below said first predetermined value;

(k) changing all of said third correction values by a third given value if said first variable value is equal to or below a second predetermined value;

(l) changing all of said third correction values by a fourth given value if said first variable value is equal to or greater than a third predetermined value; and (m) initializing said first and second variable values.

6. In a method of controlling the air/fuel ratio including a step of modifying a piece of correction information corresponding to an existing engine operation condition, a step of storing this information into a nonvolatile storage device, which is readable and writable, with relation to the engine operational conditions, and a step of controlling the air/fuel ratio in accordance with a piece of correction information corresponding to an existing engine operational condition, which has been selected from stored pieces of said correction information; wherein the improvement comprises:

a step of modifying all of said pieces of correction information by a given value when it is detected that said correction information has been modified in the same direction by a predetermined amount in view of the direction of the correction and the number of the corrections of said correction information.

7. Apparatus for controlling the air/fuel ratio of an air/fuel mixture supplied to an internal combustion engine, comprising:

(a) an airflow meter for producing an output signal indicative of the flow rate of the intake air supplied to said engine;

(b) an intake air temperature sensor for producing an output signal indicative of the temperature of the intake air of said engine;

(c) a coolant temperature sensor for producing an output signal indicative of the temperature of the coolant of said engine;

(d) a gas sensor for producing an output signal indicative of the concentration of a given gas in the exhaust gases of said engine;

(e) a rotational speed sensor for producing an output signal indicative of the engine rpm;

(f) fuel injection valves for supplying said engine with fuel in accordance with a driving current; and (g) controlling means for producing said driving current in accordance with the output signals of said airflow meter, intake air temperature sensor, coolant temperature sensor, gas sensor, and rotational speed sensor, said controlling means including a storage device in which data of correction factors are prestored, said controlling means producing said driving current by: (1) selecting a first correction factor from a plurality of predetermined first correction factors prestored in said storage device, in accordance with the output signals of said intake air temperature and said coolant temperature, (2) determining a second correction factor in accordance with said output signal of said gas sensor, (3) determining third correction factors, each of said third correction factors for a different engine operational condition, some of said third correction factors for engine operational conditions in a given region, in which said engine has been operated, being varied to be increased or decreased in accordance with the value of said second correction factor, remaining third correction factors being maintained unchanged, (4) detecting the state of the variation of said third correction factors, (5) modifying all of said third correction factors stored in said storage device in accordance with the result of the detection of the state of the variation of said third correction factors, (6) producing a pulse train signal in accordance with the output signals of said airflow meter, said rotational speed sensor and with said first, second and third correction factors, and (7) producing said driving current in response to said pulse train signal.

8. Apparatus for controlling the air/fuel ratio of an air/fuel mixture supplied to an internal combustion engine, comprising:

(a) an airflow meter for producing an output signal indicative of the flow rate of the intake air supplied to said engine;

(b) an intake air temperature sensor for producing an output signal indicative of the temperature of the intake air of said engine;

(c) a coolant temperature sensor for producing an output signal indicative of the temperature of the coolant of said engine;

(d) a gas sensor for producing an output signal indicative of the concentration of a given gas in the exhaust gases of said engine;

(e) a rotational speed sensor for producing an output signal indicative of the engine rpm;

(f) fuel injection valves for supplying said engine with fuel in accordance with a driving current; and (g) a control unit for producing said driving current in accordance with the output signals of said airflow meter, intake air temperature sensor, coolant temperature sensor, gas sensor, and rotational speed sensor; said control unit having an analog input port for respectively converting analog signals from said airflow meter, intake air temperature sensor, and coolant temperature sensor into digital signals; a digital input port for receiving a digital signal from said gas sensor; a rotational number counter for producing an interrupt instruction in synchronization with the rotation of the engine crankshaft, and for producing a digital output indicative of the engine rpm; an interrupt control unit for producing an interrupt signal in response to said interrupt instruction; a timer circuit for measuring time; a read-only memory in which a number of first correction factors have been prestored; a random access memory for temporarily storing various data on operations; a central processing unit responsive to data from said analog input port, digital input port, rotational number counter, interrupt control unit, timer circuit, read-only memory, and random access memory for producing an output signal; a second counter responsive to the output signal of said central processing unit for producing a pulse train signal; a driving stage responsive to said pulse train signal for producing said driving current; said central processing unit being operated in accordance with a program sequence prestored in said read-only memory, said program has a main routine for determining first, second and third correction factors, and an interrupt routine for determining the pulse width of said pulse train signal in accordance with the rotational speed of said engine, the amount of the intake air and said first to third correction factors, said first correction factor being selected from a plurality of predetermined first correction factors prestored in said read-only memory in accordance with the intake air temperature and coolant temperature; said second correction factor being determined in accordance with the detected air/fuel ratio; each of said third correction factors being for a different engine operating condition, some of said third correction factors for engine operational conditions in a given region, in which said engine has been operated, being varied to be increased or decreased in accordance with the value of said second correction factor, remaining third correction factors being maintained unchanged; all of said third correction factors being uniformly modified in accordance with the state of variation of said third correction factors.

9. Apparatus as claimed in claim 8, wherein a power supply circuit is directly connected to a power source for supplying said random access memory with electrical power continuously whereby said random access memory is rendered non-volatile.

10. A method of controlling the air/fuel ratio of an air/fuel mixture supplied to an internal combustion engine by a feedback control system, comprising the steps of:

(a) monitoring operating conditions of said engine;

(b) determining a first correction factor in accordance with an air/fuel ratio represented by an output signal of a gas sensor which detects the concentration of a given gas in the exhaust gases of said engine;

(c) determining second correction factors, each of said second correction factors for a different engine operating condition, second correction factors corresponding to a region of said engine operational conditions in which said engine has been operated being changed in accordance with the value of said first correction factor, remaining second correction factors being unchanged;

(d) detecting the state of variation of said second correction factors;

(e) modifying all of said second correction factors uniformly throughout the possible entire range of said operating conditions of said engine in accordance with the detected state of variation of said second correction factors; and (f) determining the air/fuel ratio of the mixture to be supplied to said engine by correcting a standard value, which is obtained on the basis of said engine operating conditions, by said first and second correction factors.

11. Apparatus for controlling the period of time that injection valves supply fuel to an internal combustion engine to control the air/fuel ratio of an air/fuel mixture supplied to said engine, comprising:

means for producing condition signals related to operating conditions of said engine;

means for producing an exhaust signal indicative of the concentration of a given gas in the exhaust gases of said engine;

memory means for storing correction factors; and means for: (1) determining a first correction factor in accordance with said exhaust signal, (2) determining second correction factors, each of said second correction factors for a different engine operating condition, some of said second correction factors for engine operational conditions in a given region, in which said engine has been operated, being varied to be increased or decreased in accordance with the value of said first correction factor, remaining second correction factors being maintained unchanged, (3) detecting the state of the variation of said second correction factors, (4) modifying all of said second correction factors stored in said storage device in accordance with the result of the detection of the state of the variation of said second correction factors, and (5) producing a driving current for said injection valves in response to said operating conditions and said first and second correction factors.

* * * * *